US012668980B2

(12) United States Patent
Pickens

(10) Patent No.: US 12,668,980 B2
(45) Date of Patent: Jun. 30, 2026

(54) PORTABLE OUTDOOR FLOORING APPARATUS

(71) Applicant: Tyrone Pickens, Indianapolis, IN (US)

(72) Inventor: Tyrone Pickens, Indianapolis, IN (US)

( * ) Notice: Subject to any disclaimer, the term of this patent is extended or adjusted under 35 U.S.C. 154(b) by 433 days.

(21) Appl. No.: 18/243,547

(22) Filed: Sep. 7, 2023

(65) Prior Publication Data

US 2025/0084648 A1 Mar. 13, 2025

(51) Int. Cl.
*E04F 15/02* (2006.01)

(52) U.S. Cl.
CPC ..... *E04F 15/02005* (2013.01); *E04F 2201/0594* (2013.01)

(58) Field of Classification Search
CPC ..... E04F 15/02005; E04F 2201/0594
USPC ..... 52/177, 71, 588.1; 404/36, 47, 40, 41, 404/48
See application file for complete search history.

(56) References Cited

U.S. PATENT DOCUMENTS 3,284,819 A * 11/1966 Nissen ..... A63C 19/04 404/35
3,512,324 A 5/1970 Reed
3,742,911 A * 7/1973 Lehe ..... A01K 1/0151 119/529
4,381,324 A * 4/1983 Ellingson, Jr. ..... E04F 19/10 428/53
4,438,605 A * 3/1984 DeLucia ..... E06B 3/486 160/206
4,488,833 A * 12/1984 Perry ..... E01D 15/22 14/27
4,568,587 A * 2/1986 Balzer ..... E04F 19/10 52/177
4,654,245 A * 3/1987 Balzer ..... A47L 23/26 52/177
4,747,441 A * 5/1988 Apolzer ..... B60J 7/041 296/100.09
4,877,672 A * 10/1989 Shreiner ..... A47L 23/26 52/177
5,066,001 A * 11/1991 Wilkinson ..... A63B 21/4037 482/52
5,088,434 A * 2/1992 Harding ..... B63B 7/082 114/345
5,157,804 A * 10/1992 Williams ..... A47L 23/26 52/177
5,502,930 A * 4/1996 Burkette ..... G09F 15/0068 52/282.1

(Continued)

FOREIGN PATENT DOCUMENTS

CA 2593600 1/2009
KR 101469629 B1 * 12/2014 ..... E01C 5/005

*Primary Examiner* — Babajide A Demuren

(57) ABSTRACT

A portable outdoor flooring apparatus for creating a stable floor outdoors includes a flooring section having a first panel and a second panel. A hinge couples together the first panel and the second panel. Each of the first and second panels have a top side, a bottom side, and a peripheral wall. The top side of the first panel is coplanar with the top side of the second panel when the first and second panels are in a deployed condition. Each of the first and second panels also have interior edges that are next to each other. The first panel and the second panel can pivot around the interior edges until the bottom sides are abutting one another. A connecting system couples the flooring section with a second flooring section when the first and second panels are in the deployed condition.

6 Claims, 12 Drawing Sheets

(56) References Cited

U.S. PATENT DOCUMENTS

| | | | | |
|---|---|---|---|---|
| 5,513,472 | A * | 5/1996 | Olsen | A47L 23/24 52/177 |
| 6,733,206 | B2 | 5/2004 | Stasiewich | |
| 7,090,430 | B1 * | 8/2006 | Fletcher | E04F 15/105 52/592.1 |
| 7,490,443 | B1 | 2/2009 | Lovald | |
| D732,208 | S | 6/2015 | Matchung | |
| 9,771,725 | B2 | 9/2017 | Matchung | |
| 2006/0285921 | A1 * | 12/2006 | Fletcher | E04F 15/16 404/35 |
| 2008/0083182 | A1 * | 4/2008 | Fletcher | E04F 15/02183 52/745.13 |
| 2008/0295437 | A1 | 12/2008 | Dagger | |
| 2017/0058536 | A1 | 3/2017 | Walens | |

* cited by examiner

PORTABLE OUTDOOR FLOORING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to modular flooring assemblies and more particularly pertains to a new modular flooring assembly for creating a stable floor outdoors.

(2) Description of Related Art Including Information Disclosed Under 37 CFR 1.97 and 1.98

The prior art relates to modular flooring assemblies. Some prior art disclosures teach interlocking mats that can be used to cover portions of the ground. Some of these mats are used to create soft or padded areas that are more comfortable for sitting or standing than the ground itself. Other mats are used to increase friction and traction across the ground surface, for example when deployed at construction or other work sites where people may be walking often or carrying heavy objects. Other such mats are used to direct fluid flowing across the ground, to improve drainage across a particular area. The prior art also discloses modular flooring assemblies that are designed for permanent installation on a patio or in a basement. These modular flooring assemblies are generally designed for permanent or near-permanent installation. For example, such assemblies may be designed to emulate a basketball court or provide decorative cover over a concrete slab in a basement or on a patio. The prior art also discloses outdoor tile assemblies which may be installed over a flat surface, for example under tents to create an outdoor dance floor. However, such tile assemblies generally need to be installed over a very flat ground surface that has sufficient drainage, or that is covered with another material such as plywood to protect the tiles from being damaged by water or dirt.

BRIEF SUMMARY OF THE INVENTION

An embodiment of the disclosure meets the needs presented above by generally comprising a flooring section having a first panel and a second panel. A hinge couples together the first panel and the second panel. Each of the first and second panels comprise a top side, a bottom side, and a peripheral wall. The peripheral wall is attached to and extends between the top and bottom sides. The top side of the first panel is coplanar with the top side of the second panel when the first and second panels are in a deployed condition. Each of the first and second panels also comprise an interior edge and three exterior edges. The interior edge of the first panel is adjacent to the interior edge of the second panel. The first panel and the second panel are hingedly coupled together such that the first panel and the second panel can pivot around the interior edges until the bottom sides are abutting one another. A connecting system removably couples the flooring section with a second flooring section when the first panel and the second panel are in the deployed condition.

There has thus been outlined, rather broadly, the more important features of the disclosure in order that the detailed description thereof that follows may be better understood, and in order that the present contribution to the art may be better appreciated. There are additional features of the disclosure that will be described hereinafter, and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
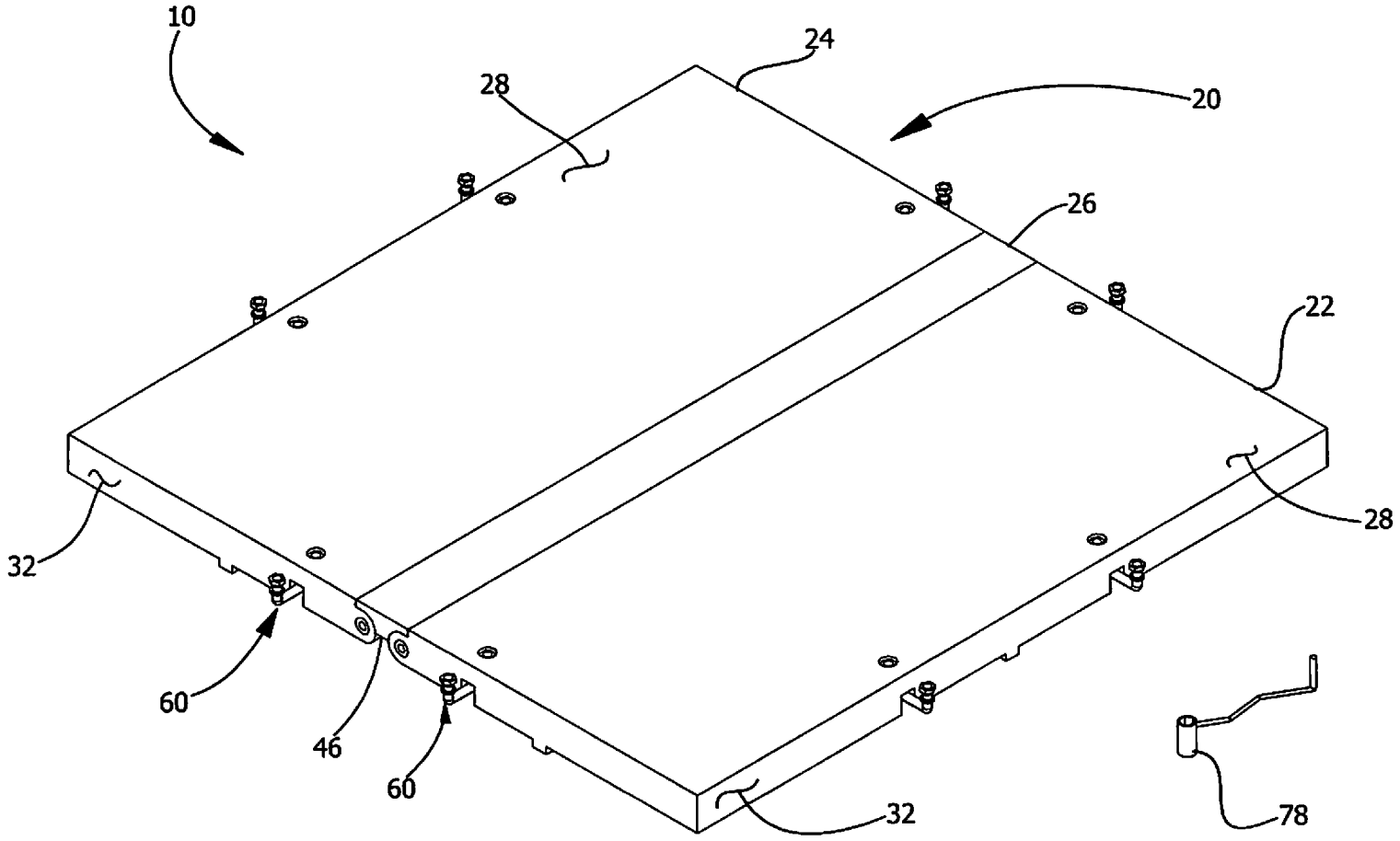
FIG. 1 is an isometric view of a portable outdoor flooring apparatus according to an embodiment of the disclosure.
Figure 2:
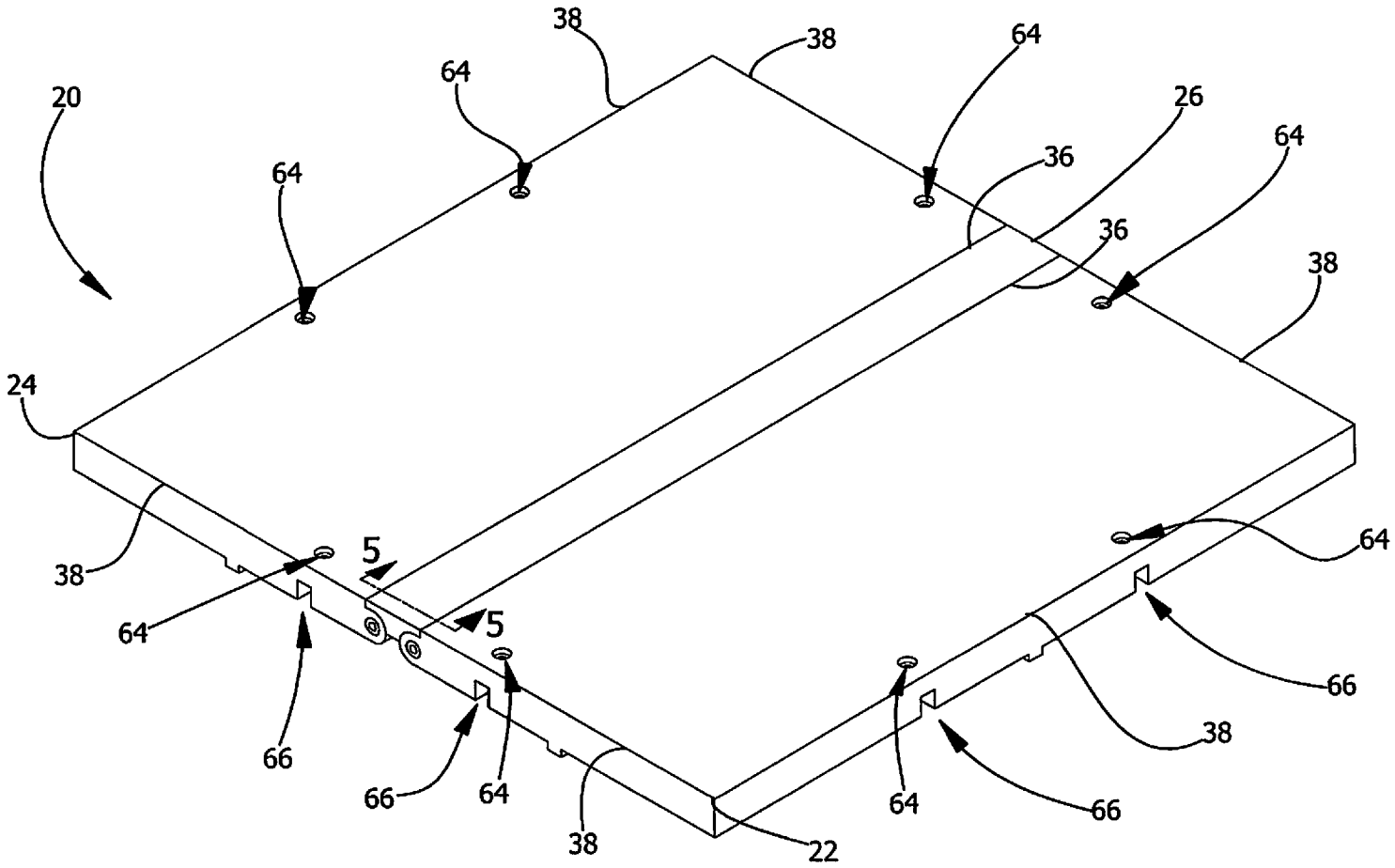
FIG. 2 is an isometric view of an embodiment of the disclosure.
Figure 3:
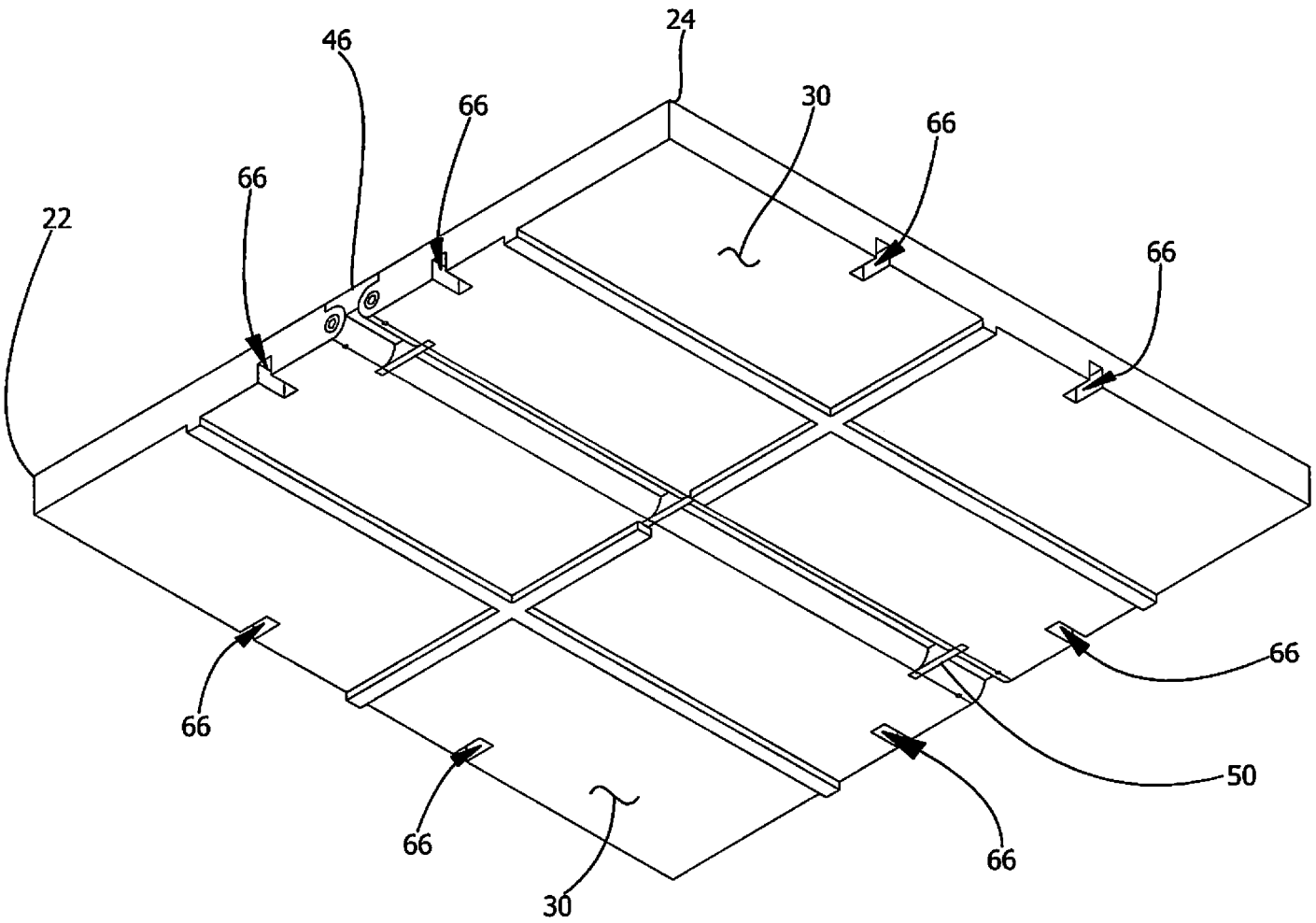
FIG. 3 is an isometric view of an embodiment of the disclosure.

With reference now to the drawings, and in particular to FIGS. 1 through 12 thereof, a new modular flooring assembly embodying the principles and concepts of an embodiment of the disclosure and generally designated by the reference numeral 10 will be described.

As best illustrated in FIGS. 1 through 12, the portable outdoor flooring apparatus 10 generally comprises a flooring section 20 having a first panel 22 and a second panel 24. A hinge 26 hingedly couples together the first panel 22 and the second panel 24.

Each of the first 22 and second 24 panels may generally comprise a top side 28, a bottom side 30, and a peripheral wall 32. The peripheral wall 32 is attached to and extends between the top 28 and bottom 30 sides. The top side 28 of the first panel 22 is coplanar with the top side 28 of the second panel 24 when the first 22 and second 24 panels are in a deployed condition 34, for example as shown in FIG. 1.

Figure 4:
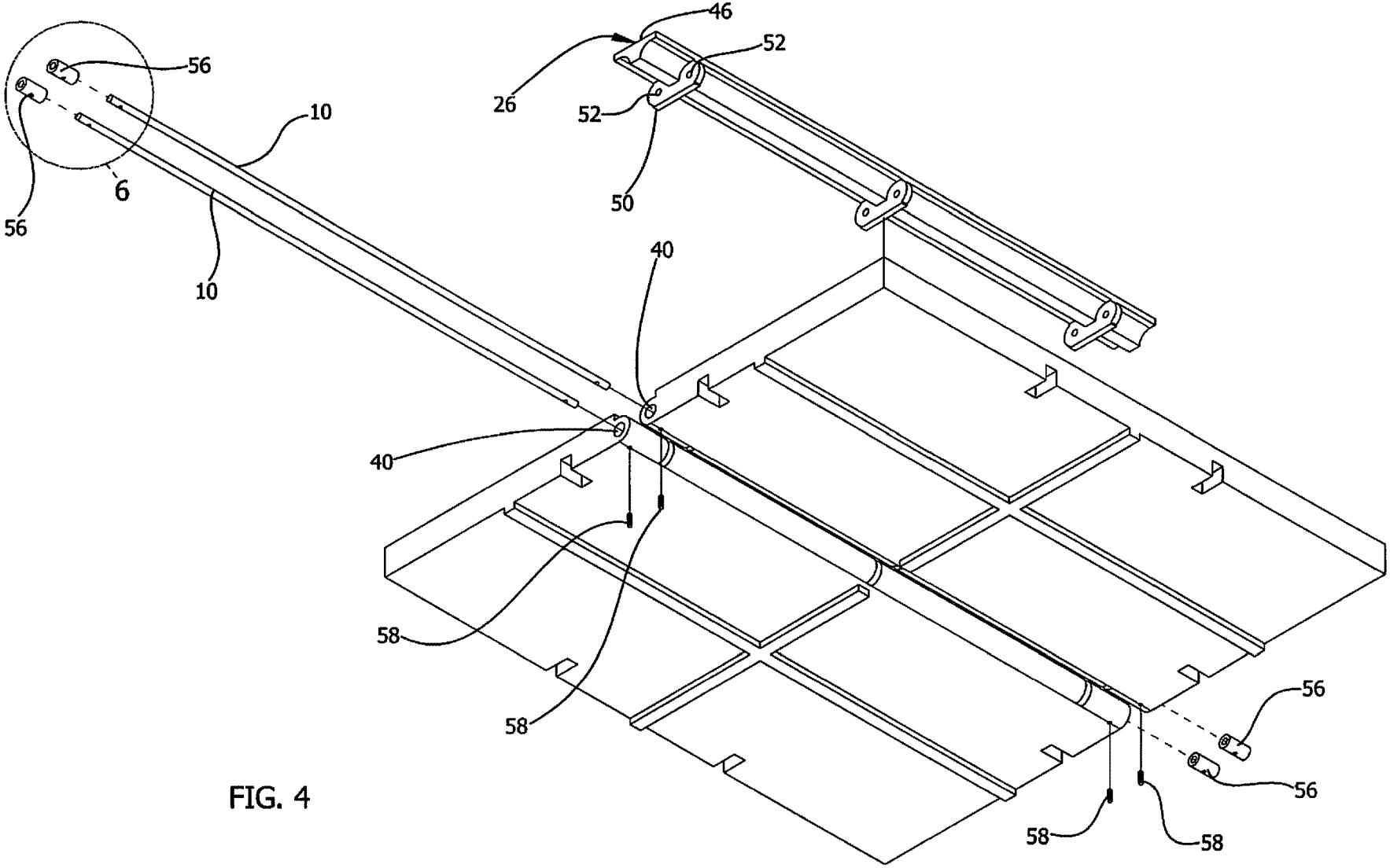
FIG. 4 is an exploded view of an embodiment of the disclosure.

Each of the first 22 and second 24 panels may further comprise an interior edge 36 and three exterior edges 38. The interior edge 36 of the first panel 22 is adjacent to the interior edge 36 of the second panel 24. In some embodiments, the interior edges 36 may each have a rod passage 40 extending therethrough. For example, the rod passages 40 may be continuous with a length of the interior edges 36, as shown in FIG. 4.

Figure 11:
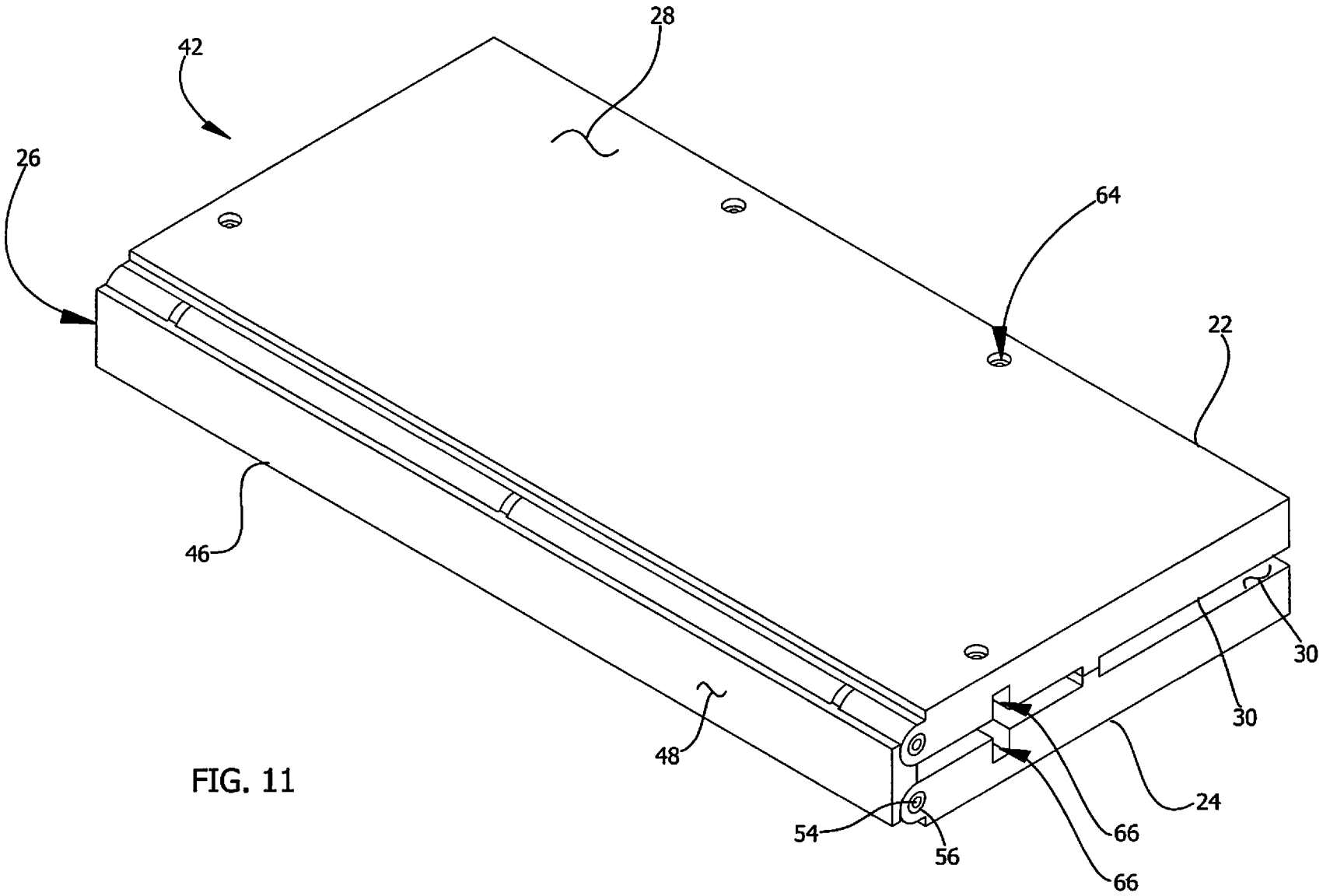
FIG. 11 is a perspective view of an embodiment of the disclosure.

The first panel 22 and the second panel 24 are hingedly coupled together such that the first panel 22 and the second panel 24 can pivot around the interior edges 36 until the bottom sides 30 are abutting one another. An example of this stored condition 42 is depicted in FIG. 11.

Figure 10:
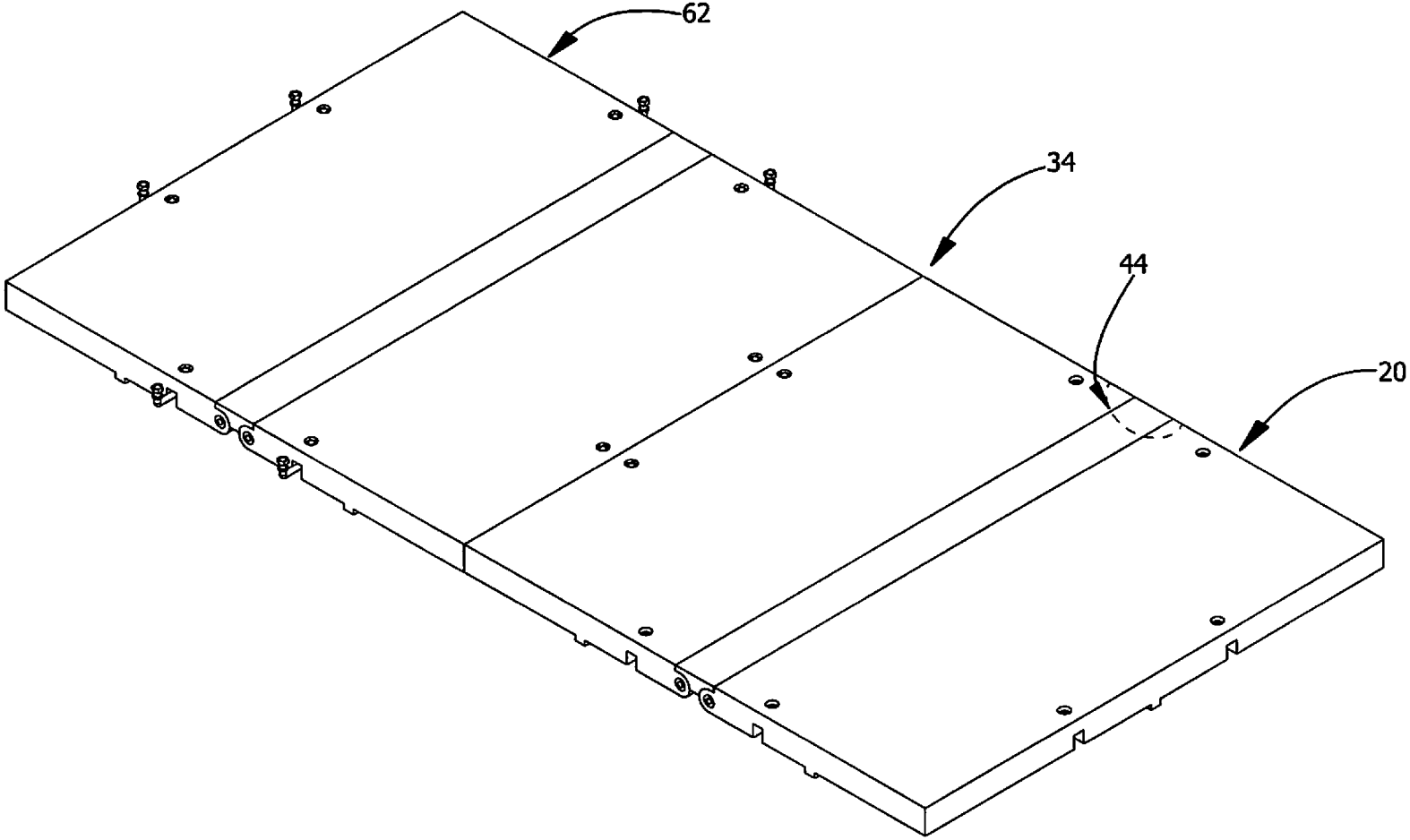
FIG. 10 is an isometric view of an embodiment of the disclosure.

The hinge 26 may also be continuous with the length of the interior edges 36 of the first 22 and second 24 panels. The hinge 26 permits the first panel 22 and the second panel 24 to pivot together in a first direction such that the bottom sides 30 are abutting one another to define the stored condition 42. The hinge 26 prevents the first panel 22 and the second panel 24 from pivoting together in a second direction beyond the deployed condition 34 to inhibit an angle 44 between the top sides 28 from being smaller than 180°, as shown in FIG. 10.

In some embodiments, the hinge 26 comprises a hinge plate 46 that is T-shaped with a planar top surface 48. The planar top surface 48 is aligned with the top side 28 of each of the first 22 and second 24 panels. The planar top surface 48 restricts the first panel 22 and the second panel 24 from pivoting in the second direction beyond the deployed condition 34.

A pivot plate 50 may be attached to the hinge plate 46 beneath the planar top surface 48. The first panel 22 and the second panel 24 may pivot around the pivot plate 50 in the first direction to form the stored condition 42, and the first 22 and second 24 panels may pivot around the pivot plate 50 in the second direction to form the deployed condition 34. The pivot plate 50 may have a pair of rod apertures 52 extending therethrough. The pair of rod apertures 52 align with the rod passages 40 of the first 22 and second 24 panels when the hinge plate 46 is coupled to the first 22 and second 24 panels. In some embodiments, the hinge 26 may include a plurality of pivot plates 50 attached to the hinge plate 46 beneath the planar top surface 48. In such embodiments, each of the plurality of pivot plates 50 may have a pair of rod apertures 52 extending therethrough that align with the rod passages 40 of the first 22 and second 24 panels.

Figure 5:
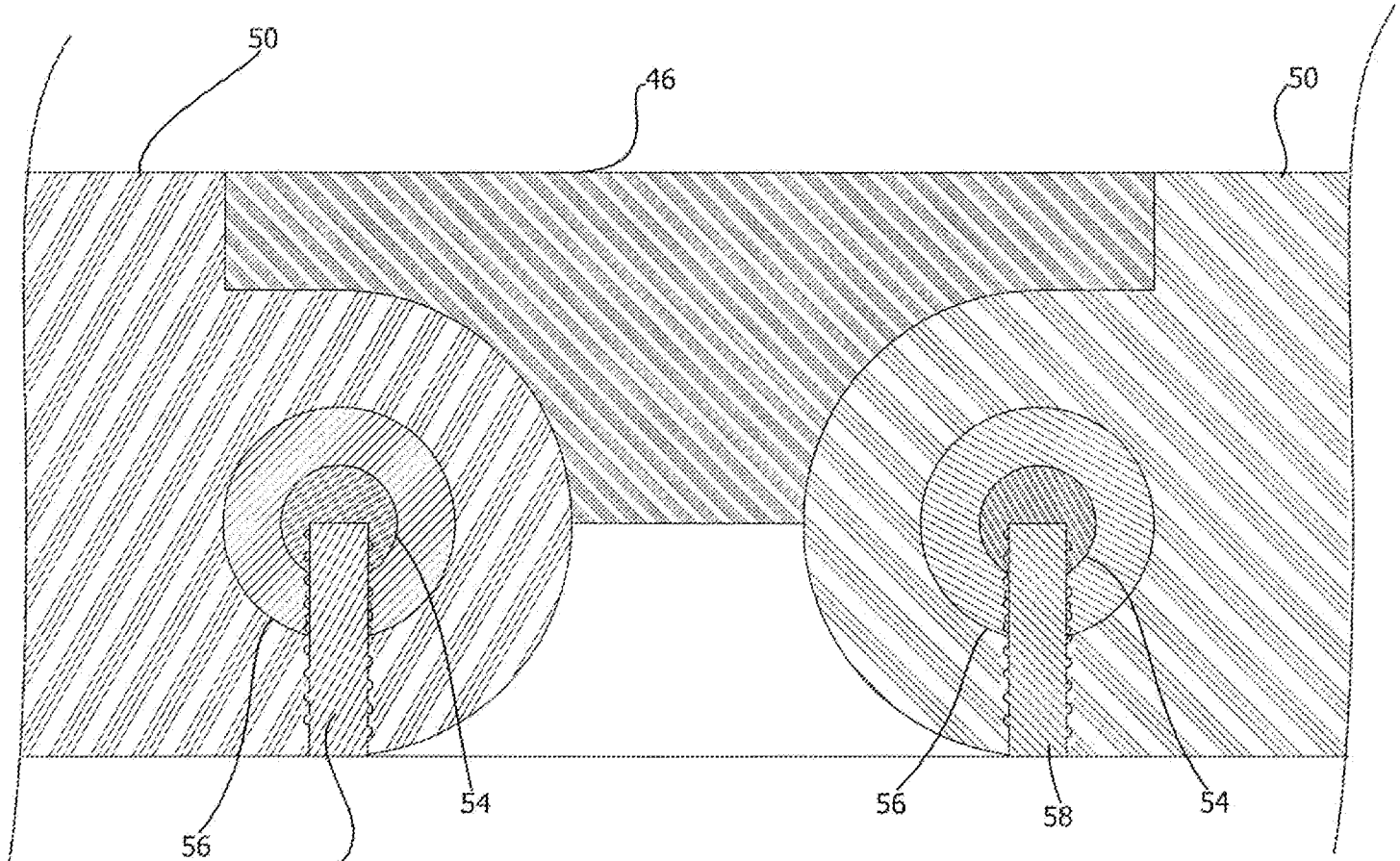
FIG. 5 is a cross-sectional view of an embodiment of the disclosure.
Figure 6:
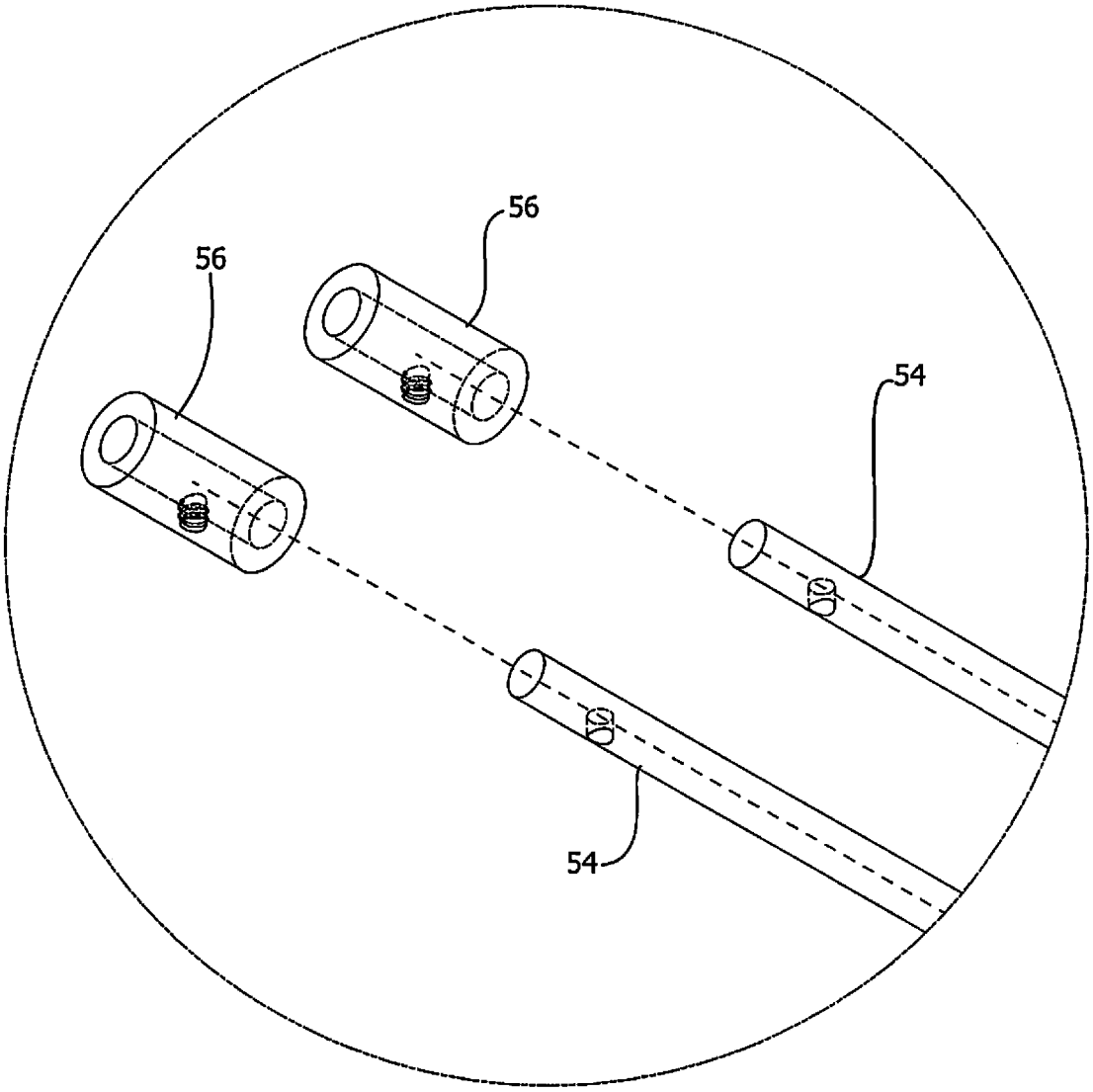
FIG. 6 is a detailed view of an embodiment of the disclosure.
Figure 7:
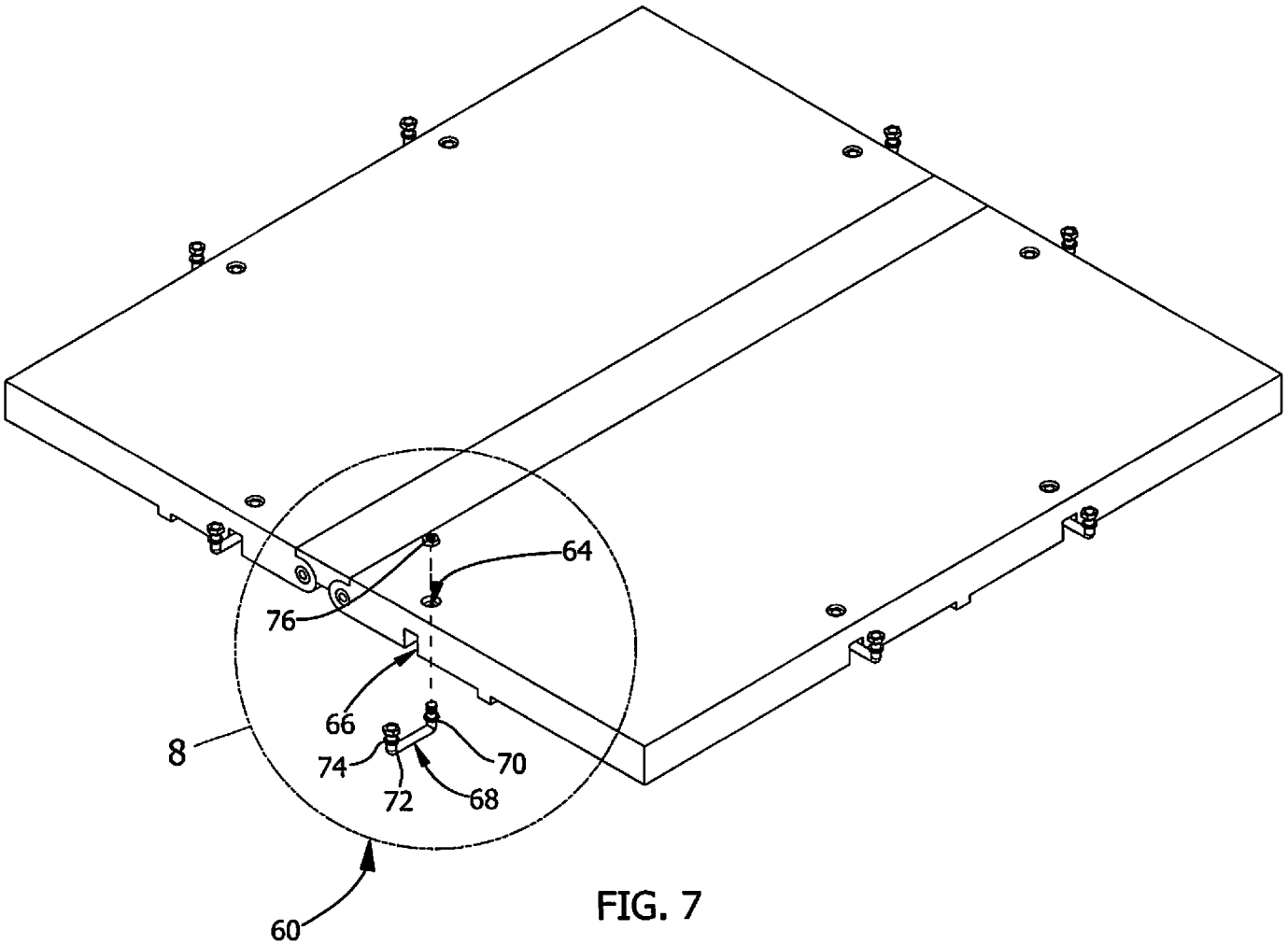
FIG. 7 is an exploded view of an embodiment of the disclosure.
Figure 8:
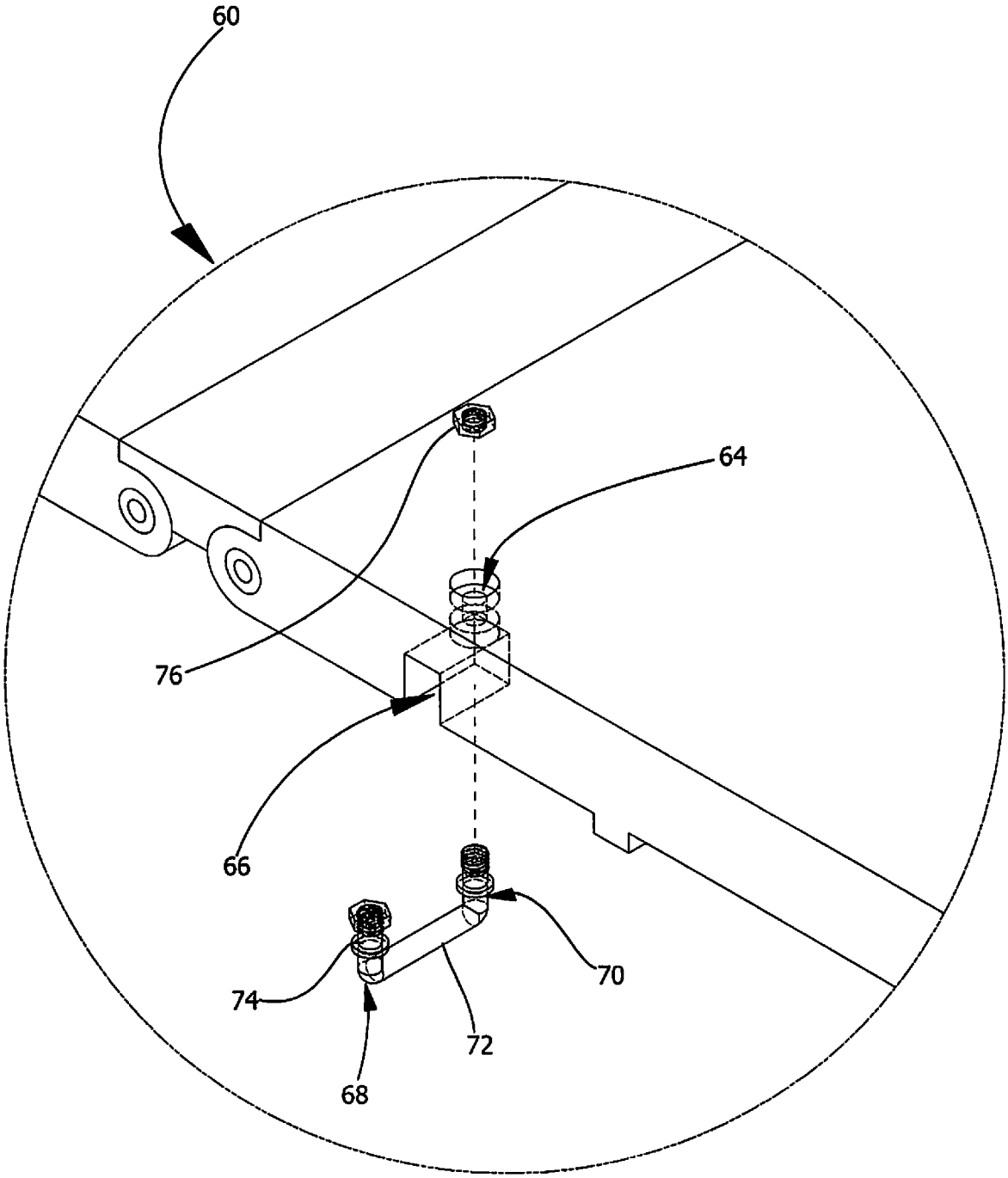
FIG. 8 is a detailed view of an embodiment of the disclosure.
Figure 9:
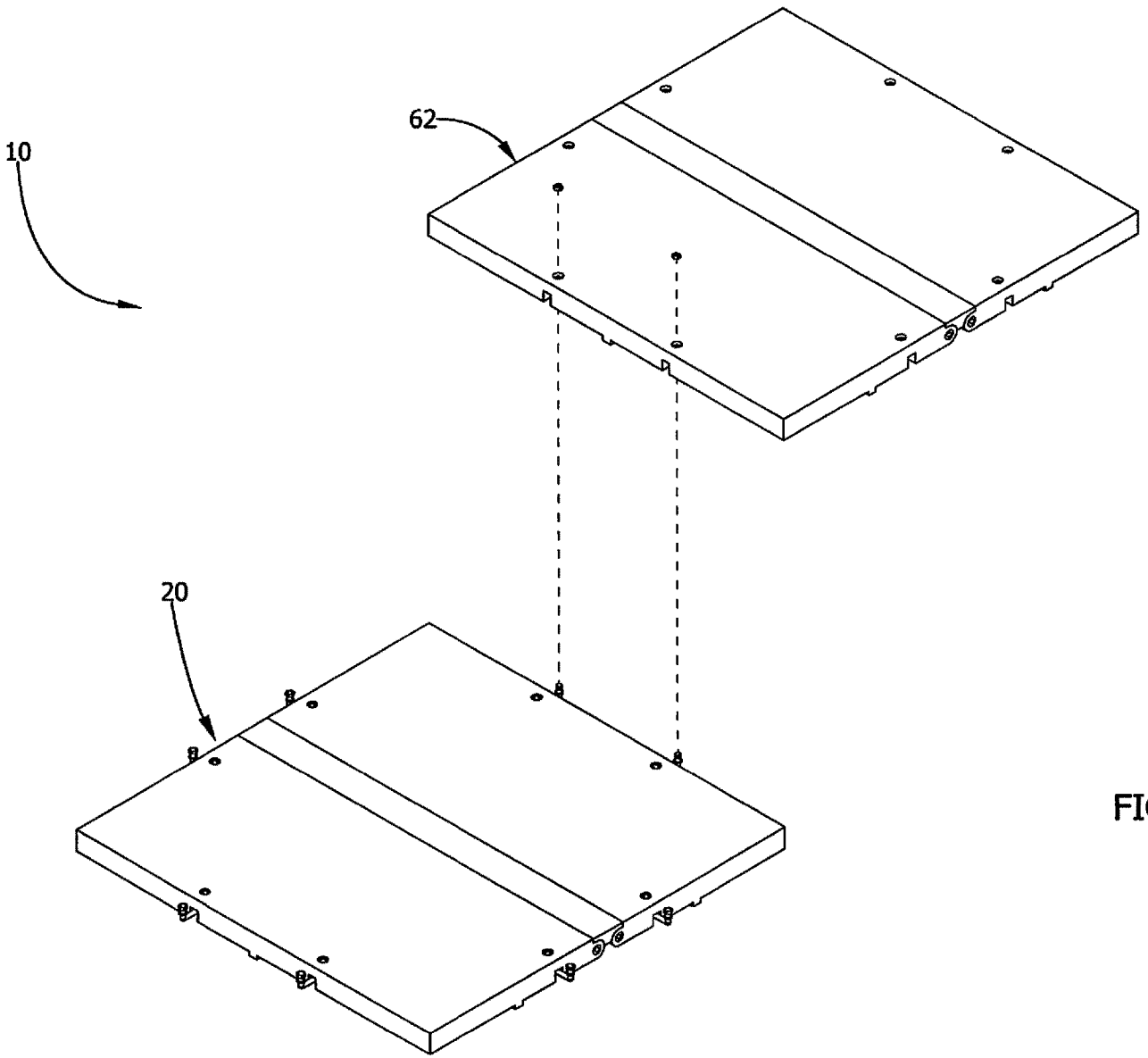
FIG. 9 is an exploded view of an embodiment of the disclosure.

A rod 54 may be inserted into each of the rod passages 40 and a corresponding one of the pair of rod apertures 52. A sleeve 56 may be inserted into the each of the rod passages 40, covering a portion of the rod 54 within the respective rod passage 40. The sleeve 56 can secure the rod 54 within the rod passage 40. A rod fastener 58 may be used to affix the sleeve 56 to the rod 54 and to the pivot plate 50. For example, the rod fastener 58 may comprise a fastening screw extending through the sleeve 56 and the rod 54, as shown in FIG. 5.

A connecting system 60 removably couples the flooring section 20 with a second flooring section 62 when the first panel 22 and the second panel 24 are in the deployed condition 34, as shown in FIGS. 7-10. The connecting system 60 may comprise a socket 64 extending through the exterior edges 38 of each of the first 22 and second 24 panels. For example, the socket 64 may extend between the top side 28 and the bottom side 30 next to the peripheral wall 32. A slot 66 may be formed in the exterior edges 38. In embodiments, the slot 66 may be formed on the bottom side 30 and may extend upwardly into the peripheral wall 32 toward the top side 28. The socket 64 is generally aligned with and extends into the slot 66.

Figure 12:
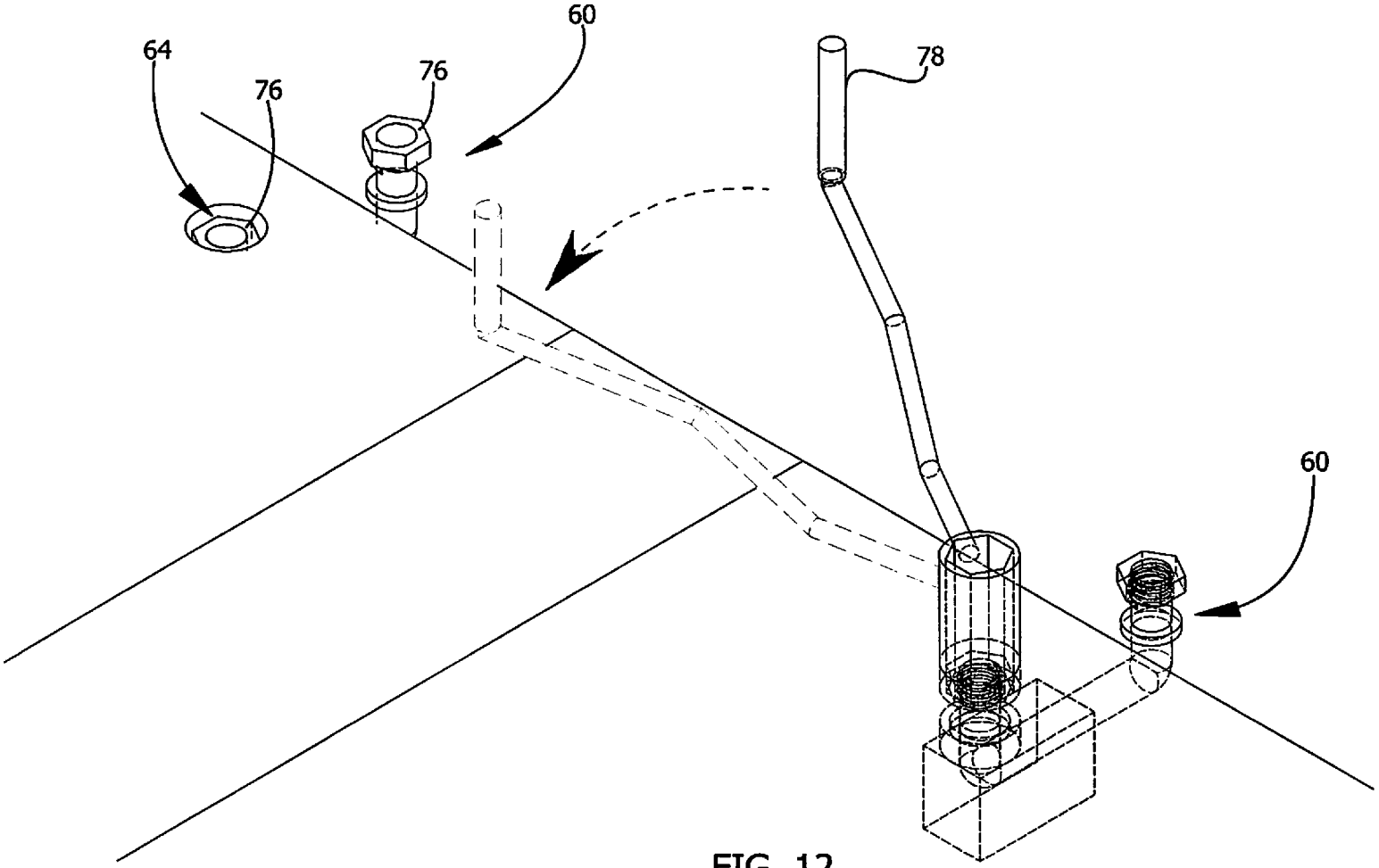
FIG. 12 is a detailed view of an embodiment of the disclosure.

A connection bar 68 may be inserted into the slot 66 and the socket 64. For example, the connection bar 68 may have a first pillar 70, a midsection 72, and a second pillar 74. The first 70 and second 74 pillars extend upwardly from the midsection 72. The first pillar 70 is spaced from the second pillar 74. The first pillar 70 may be inserted into the socket 64 through the bottom side 30. The midsection 72 may extend outwardly from the peripheral wall 32 through the slot 66. The second pillar 74 may be inserted into a corresponding socket 64 of the second flooring section 62. A bar fastener 76 may secure the connection bar 68 within the socket 64. For example, the bar fastener 76 may comprise a nut that can be tightened around each of the first 70 and the second 74 pillars within the respective sockets 64. In one embodiment, the nut may be inserted into the socket 64 through the top side 28 and positioned on the first 70 or the second 74 pillar. The nut may then be tightened around the first 70 or the second 74 pillar using a socket wrench 78, as shown in FIG. 12. In other embodiments, a different fastener may be used to secure the connection bar 68 within the socket 64.

Each flooring section may be formed of a durable material such as plastic. In some embodiments, recycled plastics or other materials may be used to form the flooring sections. Because the modular flooring apparatus will be used as a floor, for example supporting people, furniture, tents, or other objects, the materials forming each flooring section should be strong and able to support a significant amount of weight without breaking or deforming. For example, each panel should be able to support a weight of at least 200 pounds to ensure that the modular flooring apparatus will not break under the weight of a person standing or walking on the flooring sections. The bottom side may therefore be reinforced to ensure that each panel can support the required amount of weight. Because the modular flooring apparatus is designed for outdoor use, the materials should be weather-resistant and easy to clean. In other words, the materials forming each flooring section should be resistant to damage from water or dirt. Because the modular flooring apparatus is designed to be reusable, the materials forming each flooring section should also be able to be cleaned repeatedly.

In use, the flooring section 20 can be unfolded into the deployed condition 34 and removably coupled with the second flooring section 62 using the connecting system 60.

The portable outdoor flooring apparatus 10 can be used to form a temporary floor for tents or events such as weddings or parties. The portable outdoor flooring apparatus 10 can also be used to form a strong and stable floor for activities such as working, camping, recreation, or simply relaxing outside. Because each flooring section 20, 64 can be manufactured in different base sizes, a user can create any desired size of outdoor flooring by coupling enough of the flooring sections 20, 62 together. When finished with the portable outdoor flooring apparatus 10, the user simply needs to disconnect the connecting system 60 and fold each of the flooring sections 20, 64 into the stored condition 42 to facilitate transportation and storage of the apparatus 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A modular flooring apparatus comprising:

a flooring section having a first panel and a second panel, a hinge hingedly coupling together the first panel and the second panel, each of the first and second panels comprising:

a top side, a bottom side, and a peripheral wall, the peripheral wall being attached to and extending between the top and bottom sides, the top side of the first panel being coplanar with the top side of the second panel when the first and second panels are in a deployed condition;

an interior edge and three exterior edges, the interior edge of the first panel being adjacent to the interior edge of the second panel;

wherein the first panel and the second panel are hingedly coupled together such that the first panel and the second panel can pivot around the interior edges until the bottom sides are abutting one another;

wherein the hinge permits the first panel and the second panel to pivot together in a first direction such that the bottom sides are abutting one another to define a stored condition, the hinge preventing the first panel and the second panel from pivoting together in a second direction beyond the deployed condition to inhibit an angle between the top sides being smaller than 180°; and a connecting system removably coupling the flooring section with a second flooring section when the first panel and the second panel are in the deployed condition.

2. The modular flooring apparatus of claim 1, wherein the hinge is continuous with a length of the interior edges of the first and second panels.

3. The modular flooring apparatus of claim 1, wherein the interior edges of each of the first panel and the second panel have a rod passage extending therethrough.

4. The modular flooring apparatus of claim 3, the hinge further comprising:

a hinge plate, the hinge plate being T-shaped with a planar top surface, the planar top surface being aligned with the top side of each of the first and second panels, the planar top surface being configured to restrict the first panel and the second panel from pivoting in the second direction;

a pivot plate being attached to the hinge plate beneath the planar top surface, the first panel and the second panel pivoting around the pivot plate in the first direction, the pivot plate having a pair of rod apertures extending therethrough, the pair of rod apertures aligning with the rod passages of the first and second panels when the hinge plate is coupled to the first and second panels;

a rod being inserted into each of the rod passages and a corresponding one of the pair of rod apertures;

a sleeve being inserted into each of the rod passages, the sleeve covering a portion of the rod within the rod passage, the sleeve securing the rod within the rod passage; and a rod fastener affixing the sleeve to the rod and to the pivot plate.

5. The modular flooring apparatus of claim 1, the connecting system further comprising:

a socket extending through the exterior edge, the socket extending between the top side and the bottom side;

a slot being formed in the exterior edge, the slot being formed on the bottom side and extending upwardly into the peripheral wall, the socket being aligned with and extending into the slot;

a connection bar having a first pillar, a midsection, and a second pillar, the first and second pillars extending upwardly from the midsection, the first pillar being spaced from the second pillar, the first pillar being inserted into the socket through the bottom side, the midsection extending outwardly from the peripheral wall through the slot, the second pillar being inserted into a corresponding socket of the second flooring section; and a bar fastener securing the connection bar within the socket.

6. A modular flooring apparatus comprising:

a flooring section having a first panel and a second panel, a hinge hingedly coupling together the first panel and the second panel, each of the first and second panels comprising:

a top side, a bottom side, and a peripheral wall, the peripheral wall being attached to and extending between the top and bottom sides, the top side of the first panel being coplanar with the top side of the second panel when the first and second panels are in a deployed condition;

an interior edge and three exterior edges, the interior edge of the first panel being adjacent to the interior edge of the second panel, the interior edge of each of the first panel and the second panel having a rod passage extending therethrough;

wherein the first panel and the second panel are hingedly coupled together such that the first panel and the second panel can pivot around the interior edges until the bottom sides are abutting one another;

the hinge being continuous with a length of the interior edges of the first and second panels, the hinge being configured to permit the first panel and the second panel to pivot together in a first direction such that the bottom sides are abutting one another to define a stored condition, the hinge preventing the first panel and the second panel from pivoting together in a second direction beyond the deployed condition to inhibit an angle between the top sides being smaller than 180°, the hinge comprising:

a hinge plate, the hinge plate being T-shaped with a planar top surface, the planar top surface being aligned with the top side of each of the first and second panels, the planar top surface restricting the first panel and the second panel from pivoting in the second direction beyond the deployed condition;

a pivot plate being attached to the hinge plate beneath the planar top surface, the first panel and the second panel pivoting around the pivot plate in the first direction, the pivot plate having a pair of rod apertures extending therethrough, the pair of rod apertures aligning with the rod passages of the first and second panels when the hinge plate is coupled to the first and second panels;

a rod being inserted into each of the rod passages and a corresponding one of the pair of rod apertures;

a sleeve being inserted into the rod passage, the sleeve covering a portion of the rod within the rod passage, the sleeve securing the rod within the rod passage;

a screw affixing the sleeve to the rod within the pivot plate;

a connecting system removably coupling the flooring section with a second flooring section when the first panel and the second panel are in the deployed condition, the connecting system comprising:

a socket extending through the exterior edge, the socket extending between the top side and the bottom side;

a slot being formed in the exterior edge, the slot being formed on the bottom side and extending upwardly into the peripheral wall, the socket being aligned with and extending into the slot;

a connection bar having a first pillar, a midsection, and a second pillar, the first and second pillars extending upwardly from the midsection, the first pillar being spaced from the second pillar, the first pillar being inserted into the socket through the bottom side, the midsection extending outwardly from the peripheral wall through the slot, the second pillar being inserted into a corresponding socket of the second flooring section; and a nut securing the connection bar within the socket.

* * * * *